US010063012B2

(12) United States Patent
Chang et al.

(10) Patent No.: US 10,063,012 B2
(45) Date of Patent: Aug. 28, 2018

(54) ELECTRICAL CONNECTOR

(71) Applicant: LOTES CO., LTD, Keelung (TW)

(72) Inventors: Wen Chang Chang, Keelung (TW); Quan Long, Keelung (TW); Jin Zhu Wang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/684,149

(22) Filed: Aug. 23, 2017

(65) Prior Publication Data

US 2018/0062319 A1 Mar. 1, 2018

Related U.S. Application Data

(60) Provisional application No. 62/381,117, filed on Aug. 30, 2016.

(51) Int. Cl.
*H01R 31/00* (2006.01)
*H01R 13/646* (2011.01)
*H01R 13/66* (2006.01)

(52) U.S. Cl.
CPC ..... *H01R 13/646* (2013.01); *H01R 13/665* (2013.01)

(58) Field of Classification Search
CPC ..... H01R 13/646; H01R 13/6574
USPC ..... 439/607.35, 607.55, 607.05, 607.01, 660
See application file for complete search history.

(56) References Cited

U.S. PATENT DOCUMENTS 7,744,426 B2 * 6/2010 Zheng ..... H01R 12/712 439/660
8,147,276 B2 * 4/2012 Wang ..... H01R 12/724 439/660
8,454,387 B2 * 6/2013 Peng ..... H01R 13/6581 439/607.35
8,764,492 B2 * 7/2014 Chiang ..... H01R 13/05 439/676
8,801,470 B2 * 8/2014 Hsueh ..... H01R 4/023 439/607.01

(Continued)

FOREIGN PATENT DOCUMENTS

CN 103972700 A 8/2014
CN 204088689 U 1/2015

(Continued)

*Primary Examiner* — Tulsidas C Patel
*Assistant Examiner* — Peter G Leigh
(74) *Attorney, Agent, or Firm* — Locke Lord LLP; Tim Tingkang Xia, Esq.

(57) ABSTRACT

An electrical connector includes a terminal module, which includes an insulating block and multiple first terminals retained at the insulating block. Each first terminal has a first contact portion exposed from a bottom surface of the insulating block. A top surface or the bottom surface of the insulating block is concavely provided with at least one groove, each of the at least one groove located between two adjacent first terminals. The groove runs forward through a front end surface of the insulating block and extends backward beyond a rear end of the first contact portion. A second terminal is located on the insulating block. The second terminal has a second contact portion, which is exposed from the top surface of the insulating block. An insulating body is formed outside the terminal module and the second terminal by injection-molding.

24 Claims, 13 Drawing Sheets

(56) References Cited

U.S. PATENT DOCUMENTS

| | | | | |
|---|---|---|---|---|
| 8,882,515 | B2 * | 11/2014 | Lv | H01R 13/6581 439/79 |
| 9,231,356 | B1 * | 1/2016 | Ju | H01R 24/78 |
| 2015/0222059 | A1 * | 8/2015 | Little | H01R 13/6587 439/607.55 |
| 2015/0244111 | A1 * | 8/2015 | Ju | H01R 13/6585 439/607.05 |
| 2015/0364883 | A1 * | 12/2015 | Yu | H01R 24/70 439/607.27 |
| 2016/0111821 | A1 * | 4/2016 | Lan | H01R 13/646 439/607.01 |
| 2016/0118752 | A1 * | 4/2016 | Guo | H01R 13/6585 439/78 |
| 2016/0141805 | A1 * | 5/2016 | Zhao | H01R 13/504 439/607.01 |
| 2016/0149349 | A1 * | 5/2016 | Kao | H01R 13/6586 439/607.05 |

FOREIGN PATENT DOCUMENTS

| | | | |
|---|---|---|---|
| CN | 204144593 | U | 2/2015 |
| CN | 104810689 | A | 7/2015 |
| CN | 104810690 | A | 7/2015 |
| CN | 104852199 | A | 8/2015 |
| CN | 105024206 | A | 11/2015 |
| CN | 204885554 | U | 12/2015 |
| CN | 204885578 | U | 12/2015 |
| CN | 105261869 | A | 1/2016 |
| CN | 205069919 | U | 3/2016 |
| CN | 205081266 | U | 3/2016 |
| CN | 105470782 | A | 4/2016 |
| CN | 205178102 | U | 4/2016 |
| CN | 205319409 | U | 6/2016 |

* cited by examiner

ELECTRICAL CONNECTOR

CROSS-REFERENCE TO RELATED PATENT APPLICATION

This application claims priority to and the benefit of, pursuant to 35 U.S.C. § 119(e), U.S. provisional patent application Ser. No. 62/381,117 filed Aug. 30, 2016. The entire content of the above identified application is incorporated herein by reference.

FIELD

The present invention relates to an electrical connector, and more particularly to an electrical connector having a tongue piece, which is provided with a groove.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector generally includes a first terminal, a second terminal and a middle shielding sheet for resisting high-frequency interference. A manufacturing process in the prior art includes: injection-molding the first terminal and a plastic body to form a first terminal module, injection-molding the second terminal and another plastic body to form a second terminal module, inserting the middle shielding sheet between the first terminal module and the second terminal module, and then fastening the middle shielding sheet, the first terminal module and the second terminal module. The assembly method is prone to forming an assembly clearance. In a subsequent electrical connector, a first terminal module is formed by injection-molding a first terminal, a middle shielding sheet and a plastic body; a second terminal is fixed to the first terminal module; and then an insulating body is further formed outside the first terminal module and the second terminal by injection-molding. Although this method solves the problem of the assembly clearance, during the second injection-molding process, the molten plastic material does not easily circulate, thereby causing the molten plastic material to easily cover a contact portion between the first terminal and the second terminal.

Therefore, it is necessary to design a novel electrical connector, so as to overcome the foregoing problem.

SUMMARY

The present invention is directed to an electrical connector having a groove for guiding flowing of a plastic material.

To achieve the foregoing objective, one aspect of the present invention is related to an electrical connector, which includes: a terminal module, comprising an insulating block and a plurality of first terminals retained at the insulating block, each of the first terminals having a first contact portion exposed from a bottom surface of the insulating block, wherein a top surface or the bottom surface of the insulating block is concavely provided with at least one groove, each of the at least one groove located between two adjacent ones of the first terminals, and the groove runs forward through a front end surface of the insulating block and extends backward beyond a rear end of the first contact portion; a second terminal, located on the insulating block, wherein the second terminal has a second contact portion, and the second contact portion is exposed from the top surface of the insulating block; and an insulating body, formed outside the terminal module and the second terminal by injection-molding.

In one embodiment, the insulating block comprises a main body portion and a tongue piece extending forward from the main body portion, a top surface and a bottom surface of tongue piece are concavely provided with a plurality of the grooves, the first contact portion is exposed from the bottom surface of the tongue piece, and the second contact portion is exposed from the top surface of the tongue piece.

In one embodiment, each of the first terminals has a first connecting portion and a first soldering portion, the first connecting portion is connected to the first contact portion and the first soldering portion, the first connecting portion has a first extending portion connected to the first contact portion, and the first extending portion is retained in the main body portion.

In one embodiment, the terminal module comprises a positioning seat, the first connecting portion comprises a first retaining portion connected to the first extending portion and the first soldering portion, and the first retaining portion is retained in the positioning seat.

In one embodiment, the positioning seat is formed outside the first retaining portion by injection-molding.

In one embodiment, two protruding blocks are provided at two sides of the positioning seat, two fixing grooves are provided at two sides of the main body portion, and the protruding blocks are fastened into the fixing grooves.

In one embodiment, the terminal module comprises a middle shielding sheet, and the middle shielding sheet is retained in the insulating block and located between the first terminals and the second terminal.

In one embodiment, the insulating block is formed outside the first contact portion, the first extending portion, and the middle shielding sheet by injection-molding.

In one embodiment, a top surface or a bottom surface of the middle shielding sheet is partially exposed from the grooves.

In one embodiment, the middle shielding sheet is provided with a first through hole, the tongue piece comprises a bridging portion, and the bridging portion is located in the first through hole and is tightly attached to an inner edge of the first through hole.

In one embodiment, the first through hole is communicated with the grooves.

In one embodiment, the middle shielding sheet is provided with a second through hole, the tongue piece is provided with a penetration hole running through the top surface and the bottom surface of the tongue piece, the second through hole is communicated with and the penetration hole, and the second through hole is located between two adjacent ones of the first terminals.

In one embodiment, the insulating body is provided with a through slot communicated with both the second through hole and the penetration hole.

In one embodiment, a foremost end edge of the middle shielding sheet is located in front of a foremost end edge of the tongue piece.

In one embodiment, the second terminal has a second connecting portion and a second soldering portion, the second connecting portion is connected to the second contact portion and the second soldering portion, the main body portion is provided with a clamping groove, and the second connecting portion is engaged into the clamping groove.

In one embodiment, the insulating body comprises a base portion and a tongue extending forward from the base portion, and the second contact portion and the first contact portion are respectively exposed from a top surface and a bottom surface of the tongue.

In one embodiment, the first connecting portion and the second connecting portion are retained in the insulating body, the first connecting portion and the second connecting portion cross the base portion and the tongue, and both the first soldering portion and the second soldering portion penetrate through a bottom surface of the base portion.

In one embodiment, the groove is located in the tongue.

In one embodiment, the groove is located between two adjacent first contact portions.

In a further aspect of the present invention, an electrical connector includes: a terminal module, comprising an insulating block and a plurality of first terminals retained at the insulating block, each of the first terminals having a first contact portion exposed from the insulating block, wherein a top surface or the bottom surface of the insulating block is concavely provided with a groove located between two adjacent ones of the first terminals; a second terminal, located at a side of the insulating block; and an insulating body, formed outside the terminal module and the second terminal by injection-molding, wherein at least a portion of plastic of the insulating body enters the groove.

In one embodiment, the groove is located between two adjacent first contact portions.

In one embodiment, the groove runs forward through a front end surface of the insulating block.

In one embodiment, the groove extends backward beyond a rear end of the first contact portion.

In one embodiment, the groove is located between two adjacent second terminals.

In one embodiment, the insulating block is formed outside the first terminals by injection-molding.

Compared with the related art, in the electrical connector according to certain embodiments of the present invention, a groove is concavely provided on each of the top and bottom surfaces of a tongue piece. The first contact portion of each first terminal is exposed from the bottom surface of the insulating block. The groove is located between two adjacent first terminals. The groove runs forward through the front end surface of the tongue piece, and extends backward beyond the rear end of the first contact portion. When the insulating body is formed by injection-molding, the molten plastic material forming the insulating body may circulate along the groove, so as to facilitate filling of the plastic forming the insulating body.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION

Figure 1:
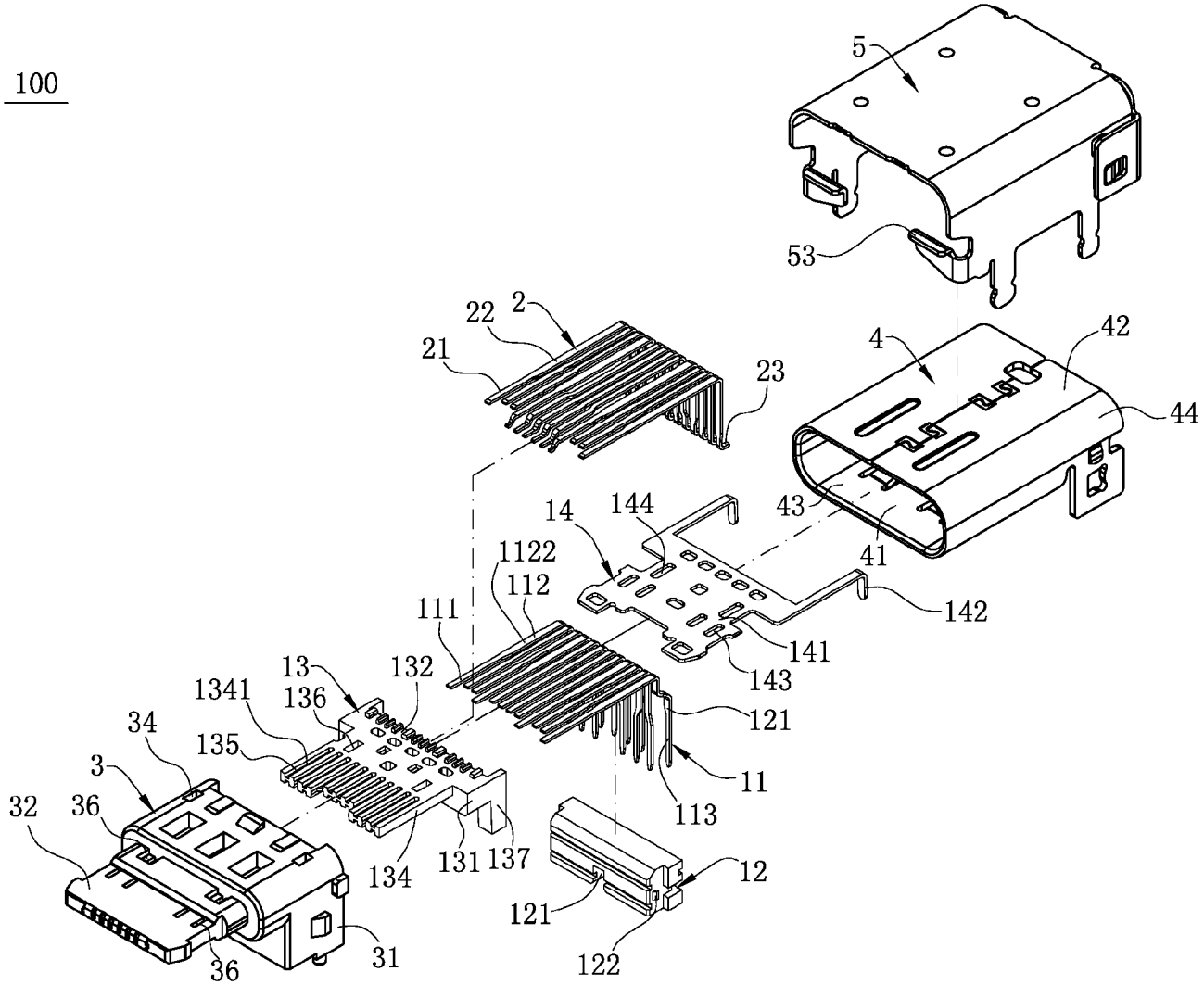
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" and/or "multiple" means two or more.

As used herein, the terms "comprising", "including", "carrying", "having", "containing", "involving", and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

Furthermore, relative terms, such as "lower" or "bottom" and "upper" or "top", may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, the abbreviated term "USB" refers to the universal serial bus.

For convenience of better understanding objectives, structures, features and efficacies of the present invention, the present invention is further described with reference to accompanying drawings and specific implementation manners.

Figure 2:
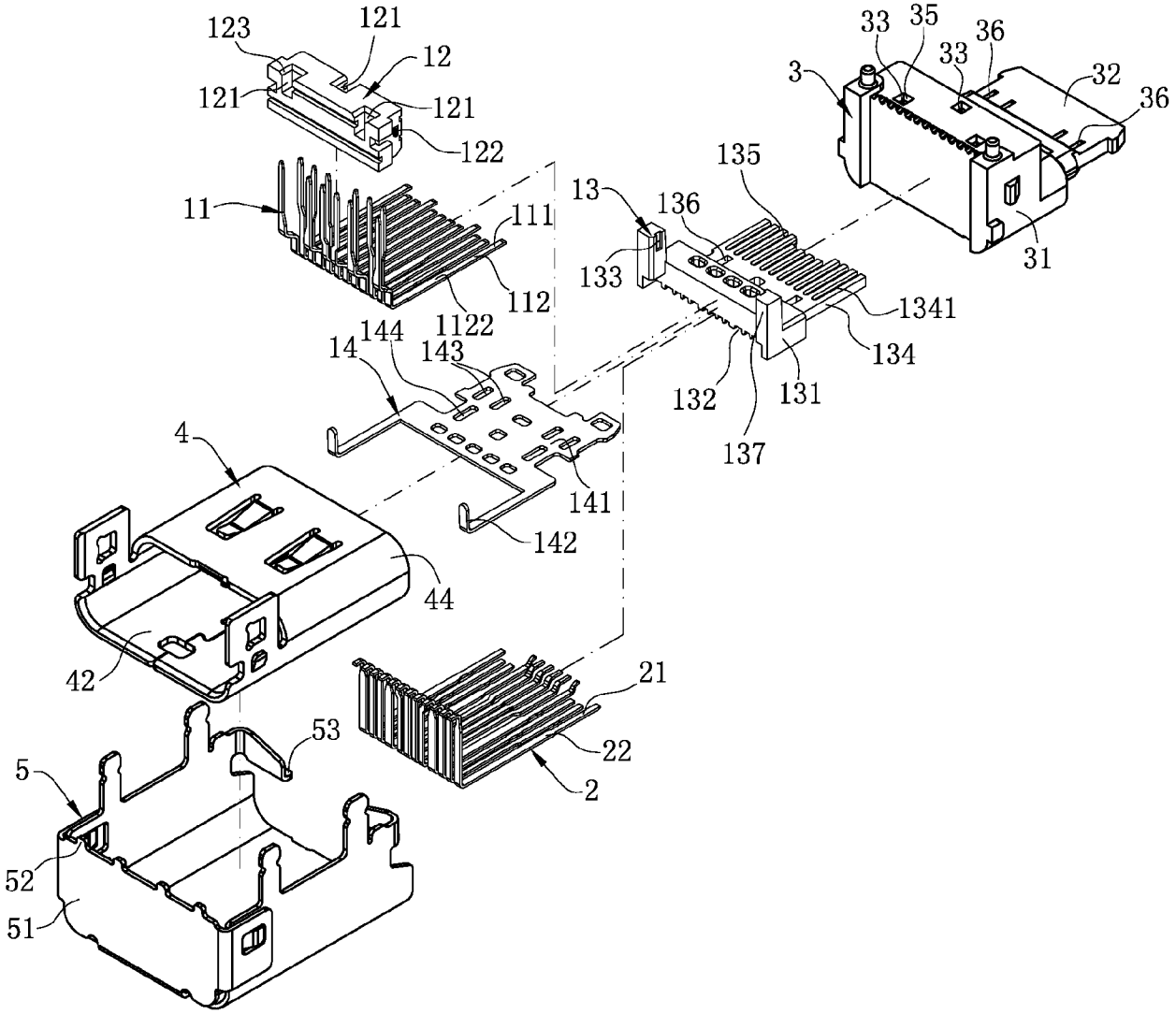
FIG. 2 is a three-dimensional exploded view of an electrical connector from another angle according to one embodiment of the present invention.
Figure 6:
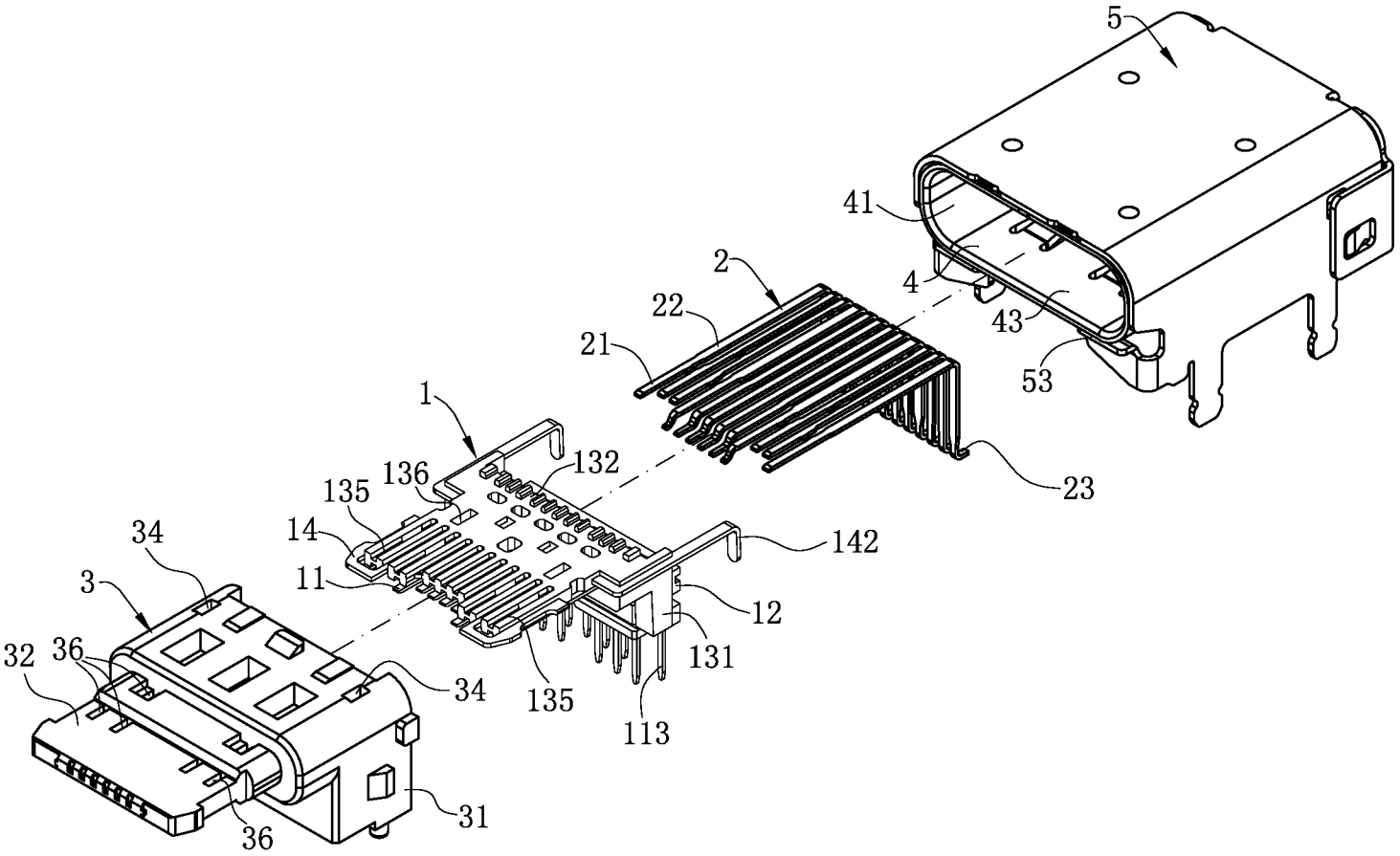
FIG. 6 is a three-dimensional view of a second molding process of an electrical connector according to one embodiment of the present invention.

As shown in FIG. 1, FIG. 2 and FIG. 6, as the most preferable embodiment, an electrical connector 100 of the present invention is used for being mounted on a circuit board (not shown). The electrical connector 100 includes a terminal module 1, a second terminal 2 and an insulating body 3. The insulating body 3 is formed outside the terminal module 1 and the second terminal 2 by injection-molding. An inner metal case 4 is disposed at the outer side of the insulating body 3 in a framing manner, and an outer metal case 5 is disposed at the outer side of the inner metal case 4 in a framing manner.

Figure 12:
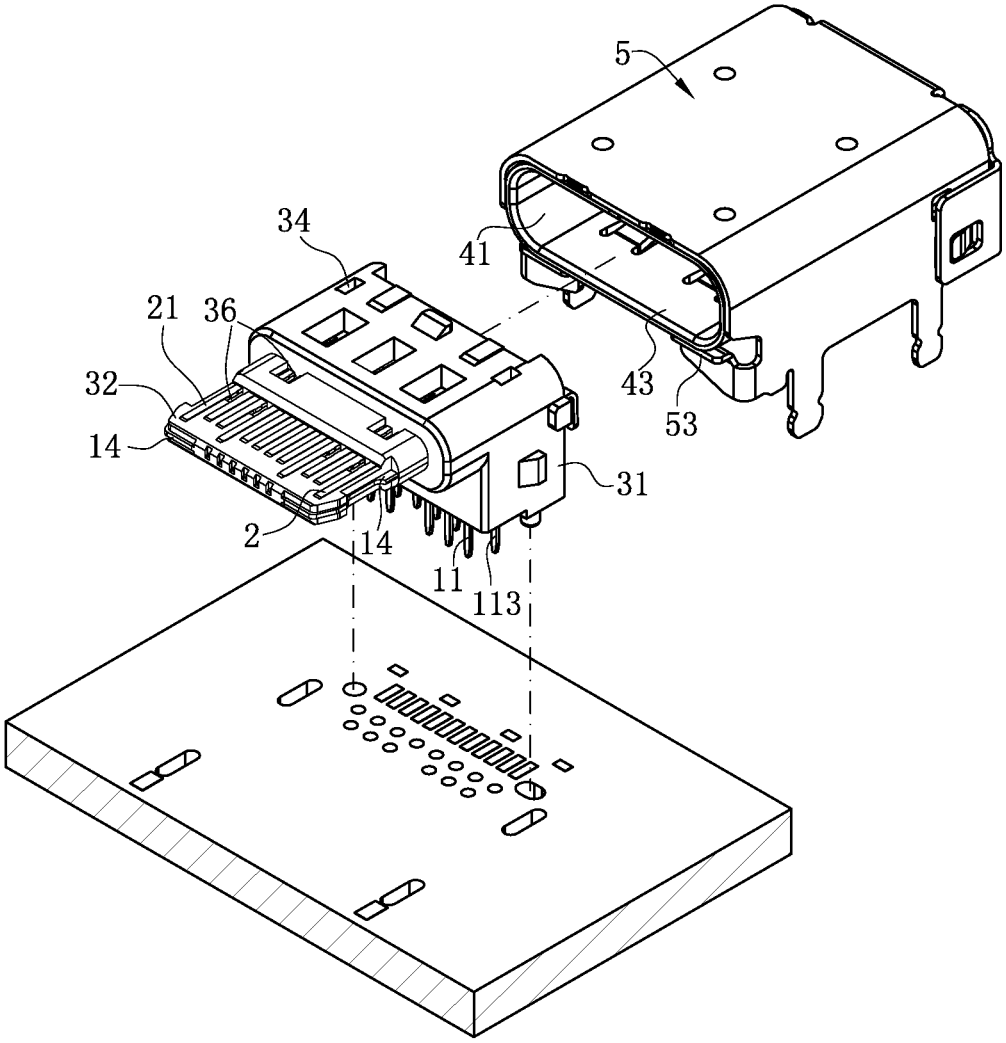
FIG. 12 is a partial three-dimensional assembled view of an electrical connector in FIG. 11 from another angle according to one embodiment of the present invention.

As shown in FIG. 1, FIG. 2 and FIG. 12, the inner metal case 4 is formed by enclosing a mating cavity 41 arranged 180 degrees symmetrically to wrap the insulating body 3. The inner metal case 4 includes a top wall 42, a bottom wall 43 and two side walls 44 connecting the top wall 42 and the bottom wall 43. The outer metal case 5 wraps the top wall 42 and the two side walls 44 of the inner metal case 4. The outer metal case 5 has a rear cover 51 at its rear side, shielding a rear end face of the insulating body 3. Four grounding pins 52 extend down vertically from the rear cover 51, and are used for being soldered to a grounding path of the circuit board. A front end of the outer metal case 5 is further provided with two supporting pins 53, supporting the bottom wall 43 of the inner metal case 4 upward.

Figure 3:
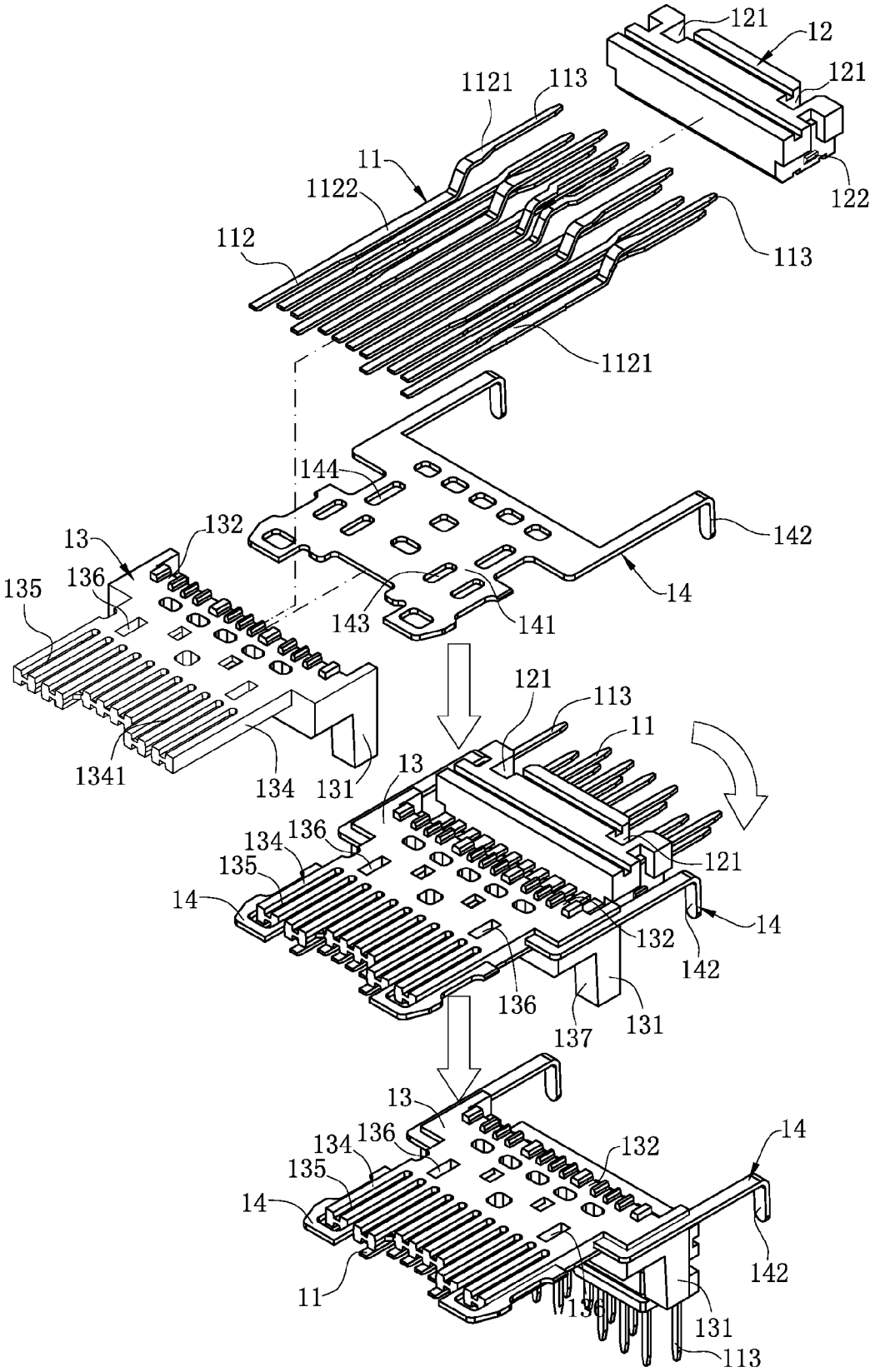
FIG. 3 is a three-dimensional view of a first molding process of an electrical connector according to one embodiment of the present invention.

As shown in FIG. 1, FIG. 2 and FIG. 3, the terminal module 1 includes a first terminal 11, a positioning seat 12, an insulating block 13 and a middle shielding sheet 14. The first terminal 11 has a first contact portion 111, a first soldering portion 113, and a first connecting portion 112 connected between the first contact portion 111 and the first soldering portion 113. The first connecting portion 112 includes a first retaining portion 1121 and a first extending portion 1122 bending forward from the first retaining portion 1121. The first retaining portion 1121 is connected to the first soldering portion 113, and the first extending portion 1122 is connected to the first contact portion 111. The first retaining portion 1121 is retained into the positioning seat 12. The first extending portion 1122 is retained in the insulating block 13. In the present embodiment, the positioning seat 12 is formed outside the first retaining portion 1121 by injection-molding, and the insulating block 13 is formed outside the first contact portion 111, the first extending portion 1122 and the middle shielding sheet 14 by injection-molding. In other embodiments, it is not limited thereto.

The positioning seat 12 is retained outside the first retaining portion 1121 of the first terminal 11, and each of the left and right sides of the positioning seat 12 is provided with a protruding block 122 protruding outward. Three mold core cavities 121 are concavely formed upward from a bottom surface of the positioning seat 12. One of the mold core cavities 121 is located at a front end of the bottom surface of the positioning seat 12, and the other two mold core cavities 121 are located at a rear end of the bottom surface of the positioning seat 12. The mold core cavity 121 located at the front end of the positioning seat 12 runs through the front end surface of the positioning seat 12, and each of the mold core cavities 121 located at the rear end of the positioning seat 12 runs through the rear end surface of the positioning seat 12. A first inclined guide surface 123 is provided in each of the mold core cavities 121. The three mold core cavities 121 are arranged to form an isosceles triangle.

The insulating block 13 is retained outside the first extending portion 1122 of the first terminal 11. The insulating block 13 includes a main body portion 131 and a tongue piece 134 extending forward horizontally from an upper end of the main body portion 131. The first extending portion 1122 is retained in the main body portion 131, and the first contact portion 111 is exposed from the bottom surface of the tongue piece 134. A top surface of the main body portion 131 is provided with multiple small protrusions, and multiple clamping grooves 132 are formed between the small protrusions. Each of the left and right sides of the main body portion 131 is provided with a fixing post 137 extending vertically, and a fixing groove 133 is concavely provided outward from each of the inner side surfaces of the two fixing posts 137. The positioning seat 12 is located between the two fixing posts 137, and the two protruding blocks 122 of the positioning seat 12 are fastened into the fixing grooves 133 respectively, such that the positioning seat 12 is fixed to the insulating block 13.

Figure 4:
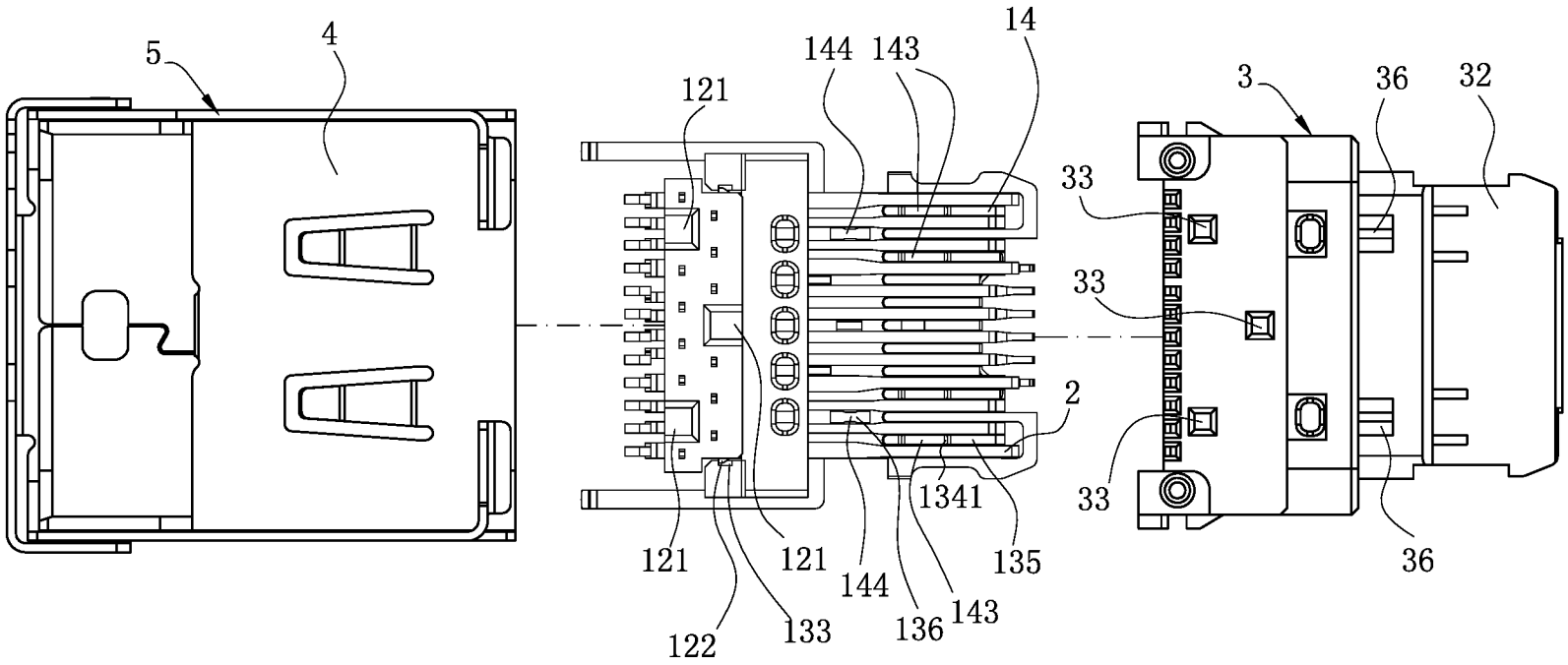
FIG. 4 is a partial three-dimensional view of an electrical connector according to one embodiment of the present invention.
Figure 5:
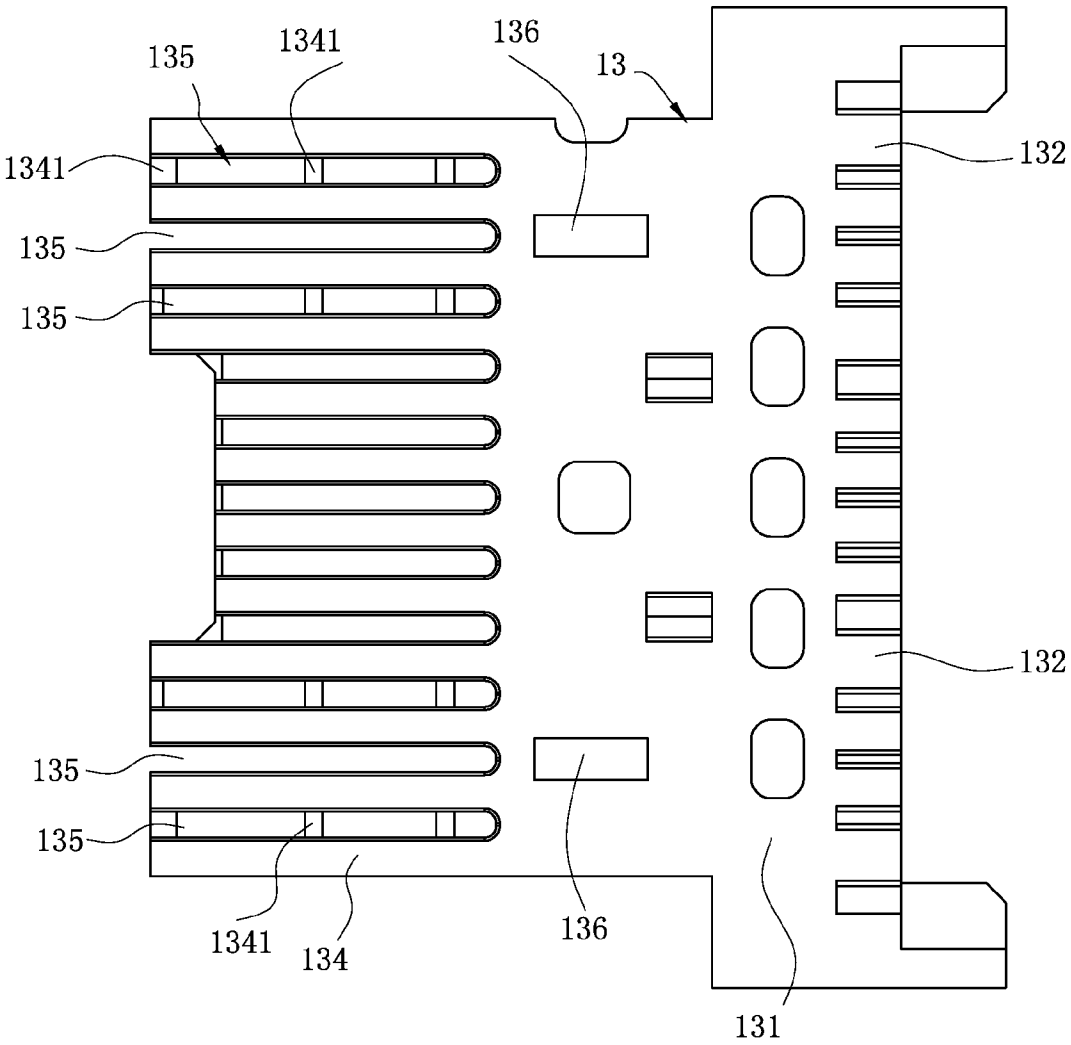
FIG. 5 is a three-dimensional view of a second molding process of an electrical connector according to one embodiment of the present invention.

As shown in FIG. 4 and FIG. 5, the top and bottom surfaces of a front end of the tongue piece 134 are concavely provided with multiple grooves 135. Each of the grooves 135 runs through the front end surface of the tongue piece 134, and extends backward to be behind the first contact portion 111. That is, the rearmost end of the inner edge of each of the grooves 135 is located behind the first contact portion 111. Each of the grooves 135 is located between two adjacent ones of the first contact portions 111, such that one of the grooves 135 is provided between each two adjacent first contact portions 111. Moreover, the grooves 135 located on the top and bottom surfaces of the tongue piece 134 are vertically correspondingly positioned, and are vertically symmetrically disposed relative to the middle shielding sheet 14. The tongue piece 134 has multiple bridging portions 1341. The bridging portions 1341 are located in the grooves 135 and connected to the inner edges of the left and right sides of the grooves 135. The tongue piece 134 is further provided with multiple penetration holes 136 running through the top and bottom surfaces of the tongue piece 134.

Figure 13:
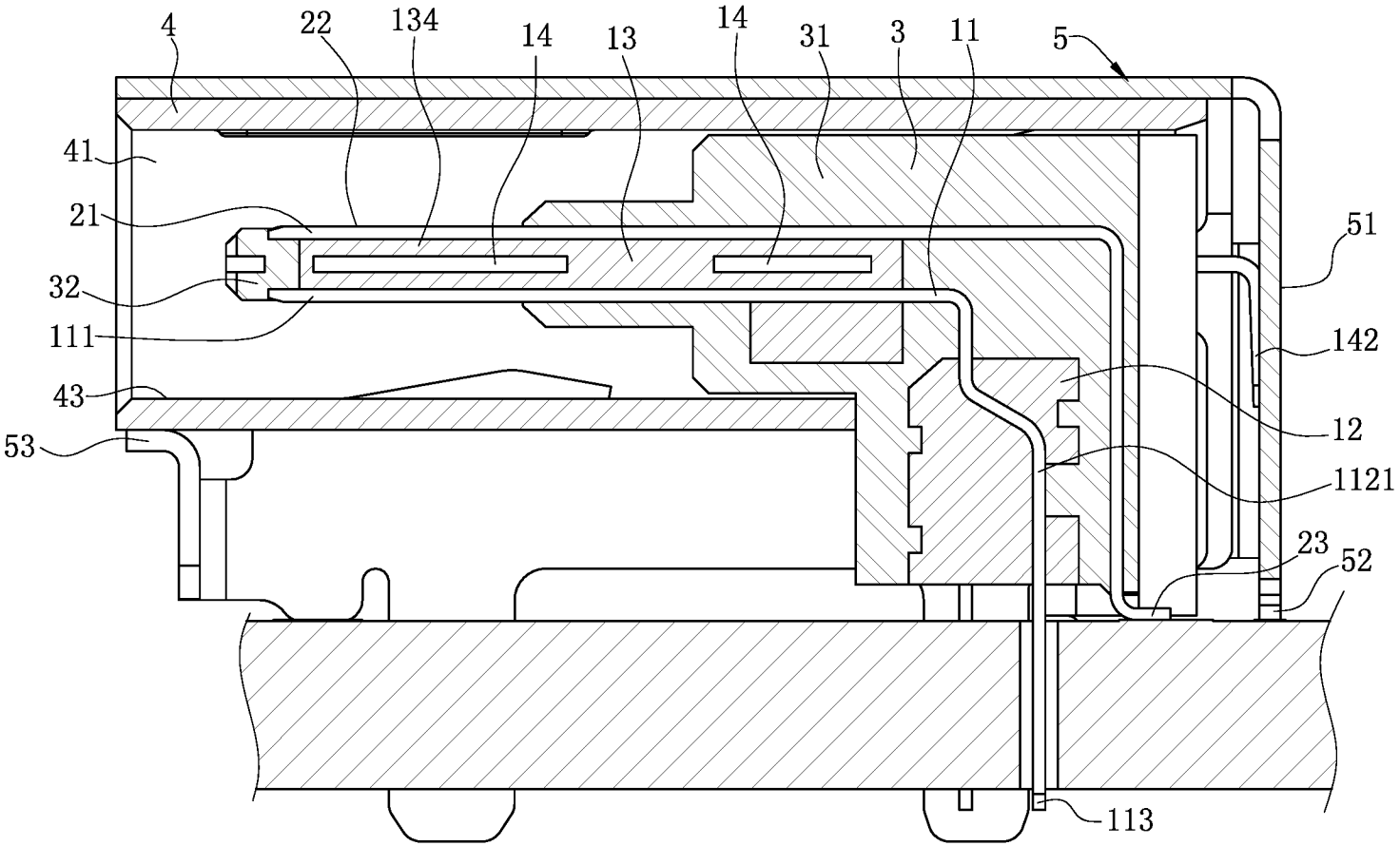
FIG. 13 is a sectional view of an electrical connector from another angle according to one embodiment of the present invention.

The middle shielding sheet 14 is located above the first terminal 11 and retained in the insulating block 13. The middle shielding sheet 14 includes a flat plate portion 141 and two pins 142 extending backward and then bending downward from the two sides of the flat plate portion 141. As shown in FIG. 13, the pins 142 abut the rear cover 51 of the outer metal case 5, thereby grounding the middle shielding sheet 14. The flat plate portion 141 is provided with multiple first through holes 143 corresponding to and communicated with the grooves 135 located on the top and bottom surfaces of the tongue piece 134. The bridging portions 1341 of the tongue piece 134 are located in the first through holes 143 and tightly attached to the inner edges of the first through holes 143. The middle shielding sheet 14 exceeds forward beyond the tongue piece 134. That is, the foremost end edge of the middle shielding sheet 14 is located in front of the foremost end edge of the tongue piece 134. The flat plate portion 141 is further provided with multiple second through holes 144 corresponding to and communicated with the penetration holes 136, for convenience of cutting off the material bridges of the terminals. A top surface of the middle shielding sheet 14 is partially exposed from the grooves 135 located on the top surface of the tongue piece 134, and a bottom surface of the middle shielding sheet 14 is partially exposed from the grooves 135 located on the bottom surface of the tongue piece 134.

Figure 7:
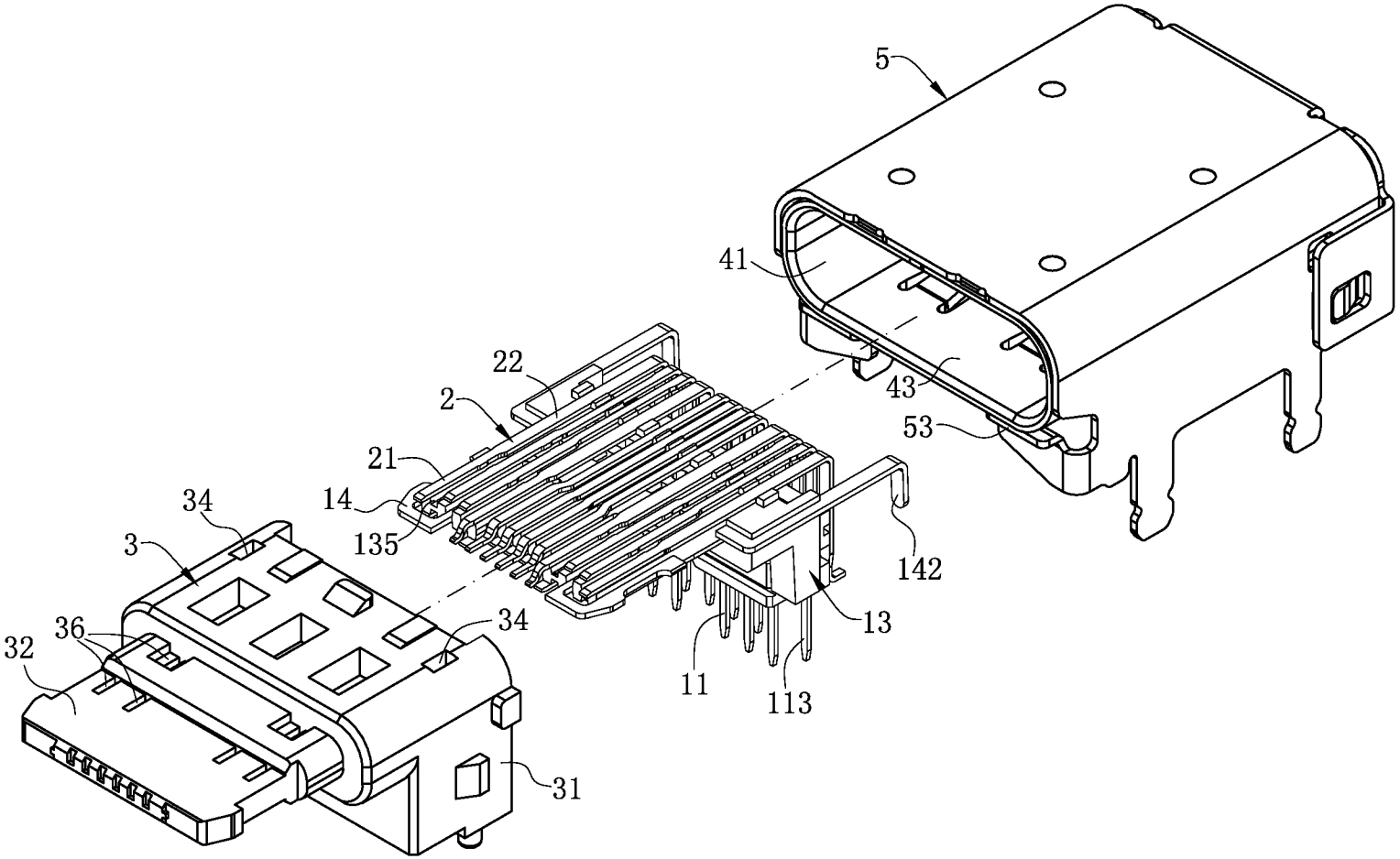
FIG. 7 is a three-dimensional view of a third molding process of an electrical connector according to one embodiment of the present invention.

As shown in FIG. 6 and FIG. 7, the second terminal 2 is located on the terminal module 1. The middle shielding sheet 14 is located between the first terminal 11 and the second terminal 2 for shielding signal interference between the second terminal 2 and the first terminal 11, thereby enhancing the shielding effect of the electrical connector 100. The second terminal 2 includes a second contact portion 21, a second soldering portion 23, and a second connecting portion 22 connected to the second contact portion 21 and the second soldering portion 23. The second connecting portion 22 is correspondingly engaged into one of the clamping grooves 132 of the main body portion 131, thereby retaining the second terminal 2 onto the terminal module 1. The second contact portion 21 is tightly attached to the top surface of the tongue piece 134 and exposed from the top surface of the tongue piece 134. Each of the grooves 135 is located between two adjacent second contact portions 21.

Figure 8:
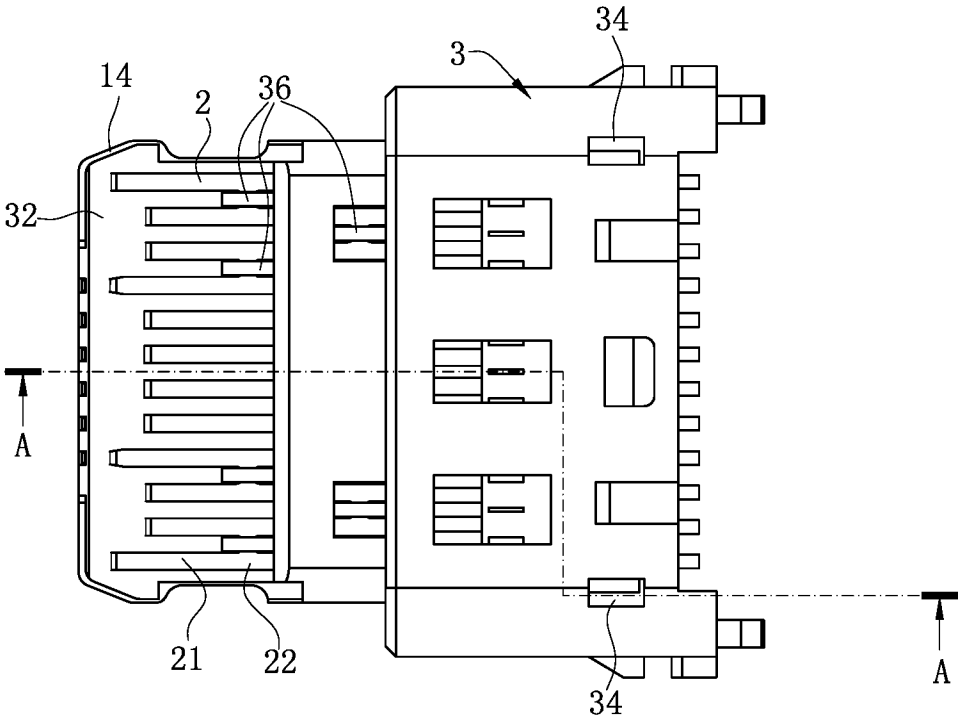
FIG. 8 is a partial three-dimensional assembled view of an electrical connector according to one embodiment of the present invention.
Figure 9:
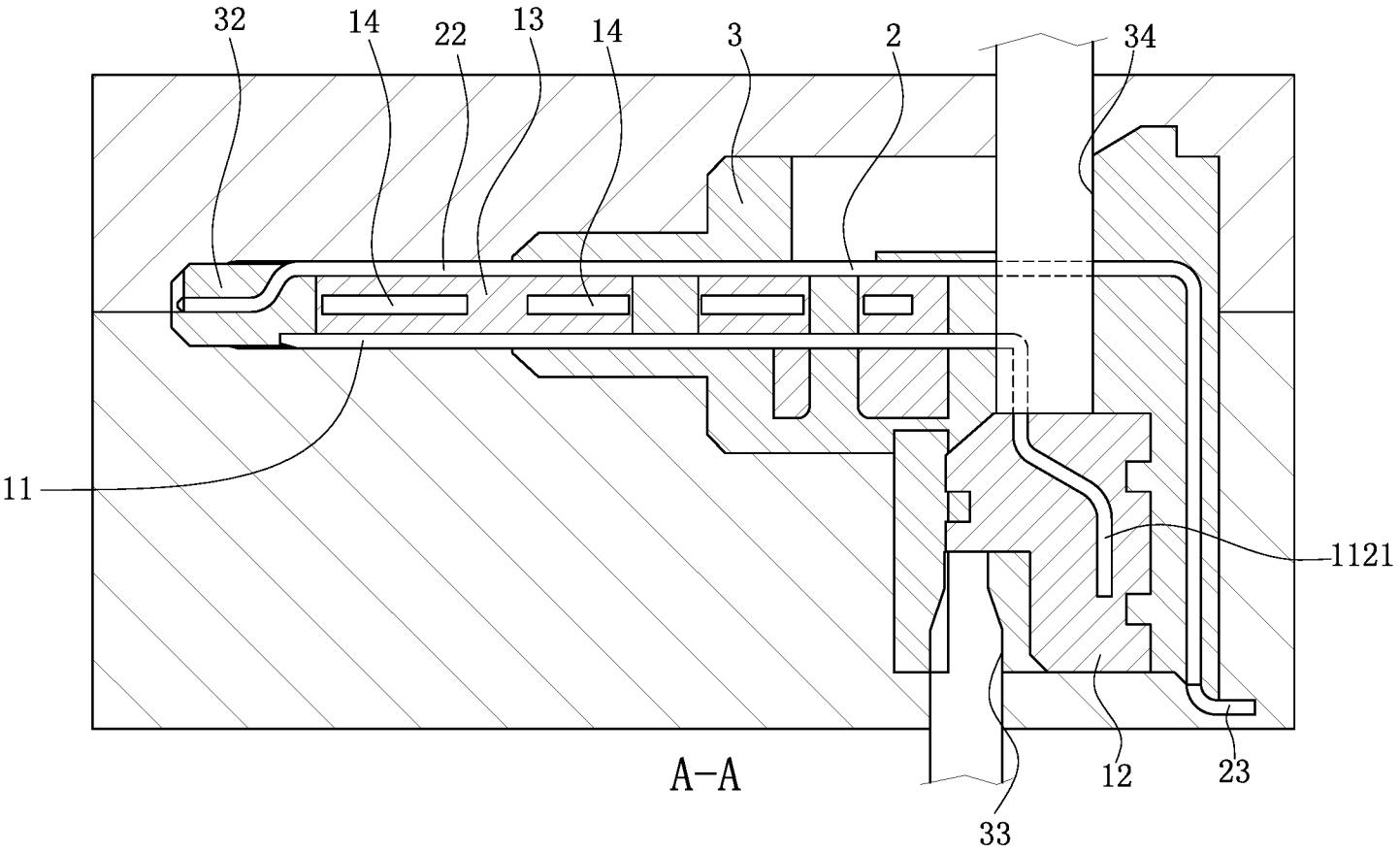
FIG. 9 is a sectional view of an electrical connector along line A-A in FIG. 8 according to one embodiment of the present invention.
Figure 10:
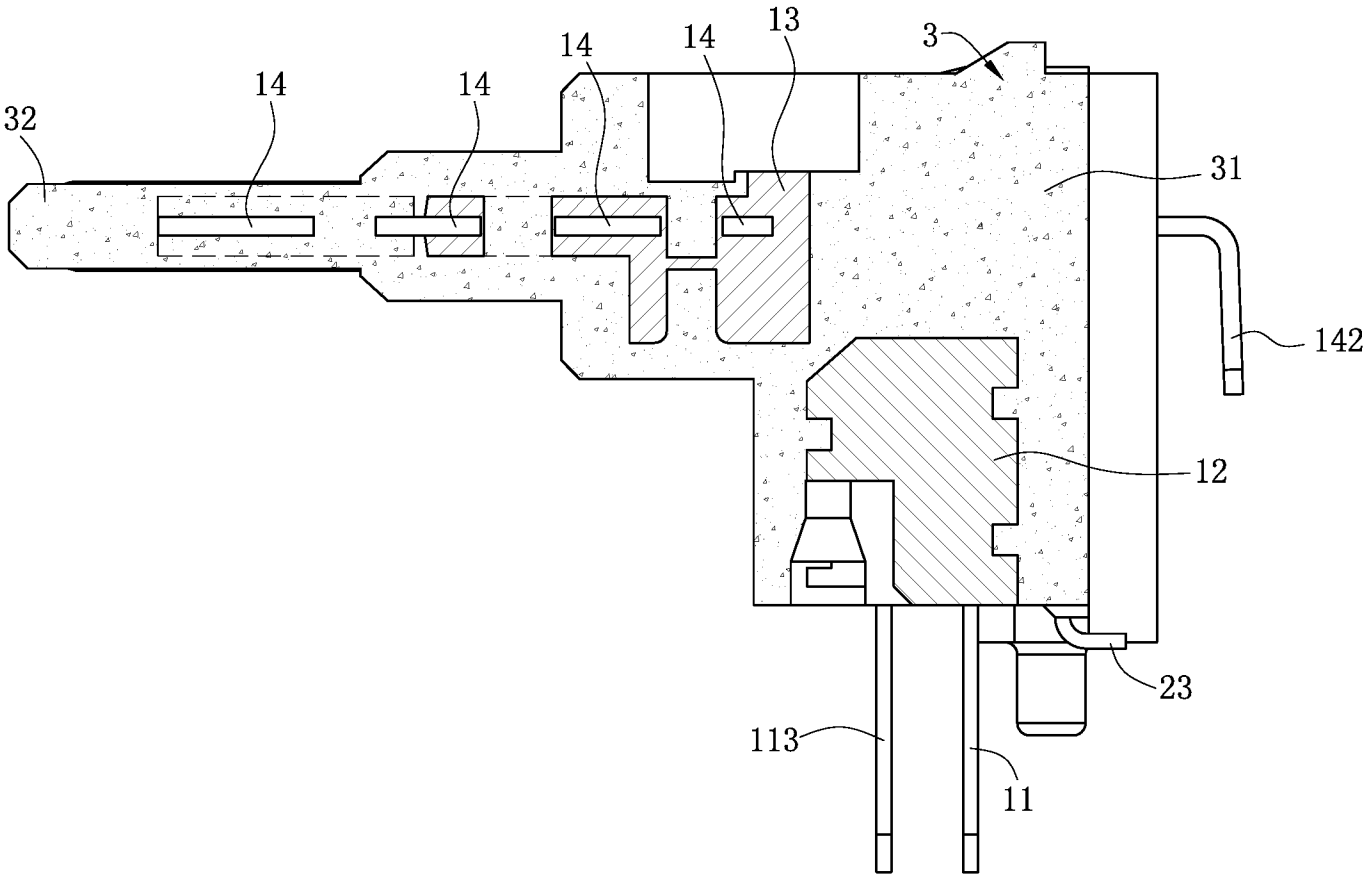
FIG. 10 is a sectional view of an electrical connector according to one embodiment of the present invention.
Figure 11:
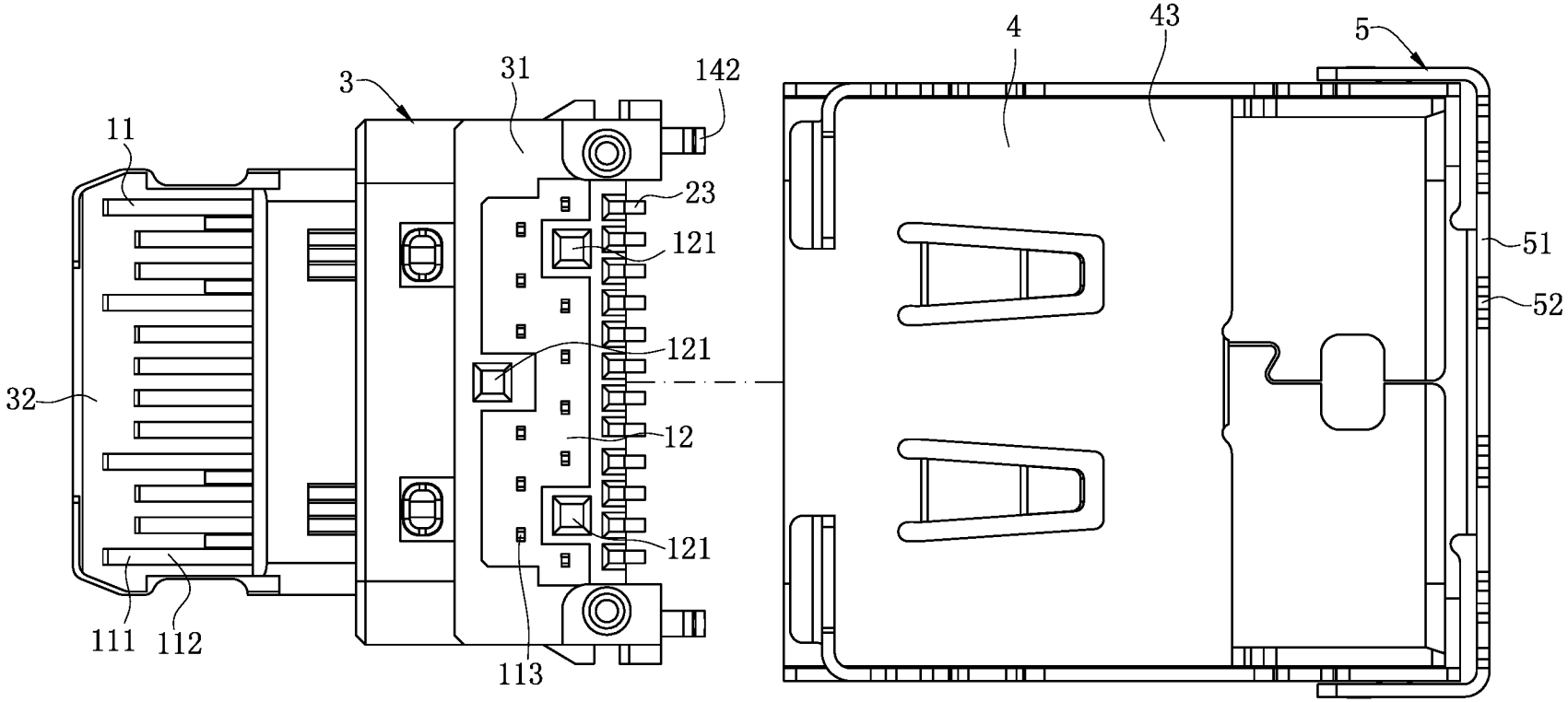
FIG. 11 is a partial three-dimensional assembled view of an electrical connector from another angle according to one embodiment of the present invention.

As shown in FIG. 9, FIG. 10 and FIG. 12, the insulating body 3 is formed outside the terminal module 1 and the second terminal 2 by injection-molding. The insulating body 3 includes a base portion 31 and a tongue 32 extending forward from the base portion 31. The base portion 31 is relatively wide and large, while the tongue 32 is relatively narrow and long. Three first mold core holes 33 are concavely formed upward from a bottom surface of the base portion 31. Two second mold core holes 34 are concavely formed downward from a top surface of the base portion 31. One of the first mold core holes 33 is located at a front end of the bottom surface of the base portion 31, and the other two first mold core holes 33 are located at a rear end of the bottom surface of the base portion 31, such that the three first mold core holes 33 are arranged to form an isosceles triangle. As shown in FIG. 8 and FIG. 11, each of the second mold core holes 34 extends to the top surface of the positioning seat 12, and each of the first mold core holes 33 extends into the mold core cavity 121. The tongue 32 is provided with multiple through slots 36, which run through the top and bottom surfaces of the tongue 32. The through slots 36 located at the rear end of the tongue 32 are communicated with the penetration holes 136 and the second through holes 144, and the through slots 36 located at the front end of the tongue 32 are communicated with the grooves 135 and the first through holes 143. A second inclined guide surface 35 is provided in each of the first mold core holes 33.

As shown in FIG. 8, FIG. 11 and FIG. 12, both the second terminal 2 and the first terminal 11 are retained into the insulating body 3 and arranged in an upper row and a lower row. The middle shielding sheet 14 is also retained into the insulating body 3 and located between the first terminal 11 and the second terminal 2. The first contact portion 111 is exposed from the bottom surface of the tongue 32. The first soldering portion 113 protrudes out of the bottom surface of the base portion 31. The first connecting portion 112 is retained into the base portion 31 and the tongue 32. The second contact portion 21 is exposed from the top surface of the tongue 32. The second soldering portion 23 protrudes out of the bottom surface of the base portion 31. The second connecting portion 22 is retained into the base portion 31 and the tongue 32. The positioning seat 12 is located in the base portion 31. The tongue piece 134 is located in the tongue 32. The main body portion 131 is located in the base portion 31. The grooves 135 on the tongue piece 134 are used as plastic flowing passages during injection-molding of the insulating body 3, so as to facilitate plastic filling.

As shown in FIG. 1, FIG. 2 and FIG. 12, the first terminal 11 and the second terminal 2 totally include four ground terminals located in an upper row and a lower row respectively, and both the two outermost terminals in the first terminal 11 and the second terminal 2 are the ground terminals. In the present embodiment, the first terminal 11 and the second terminal 2 each includes 12 terminals, and the 12 terminals located in the upper row and the 12 terminals located in the lower row are in a left-and-right opposite arrangement order and in a vertically symmetrical arrangement mode, and the transmitted signals are the same. The arrangement order from left to right of the multiple terminals in the upper row is sequentially a ground terminal (GND), a pair of differential signal high-speed transmission terminals (TX1+, TX1−, i.e. a pair of USB 3.0 terminals), a power terminal (Vbus), a reserved terminal (CC1), a pair of USB 2.0 differential terminals (Dp1, Dn1), a reserved terminal (SBU1), a power terminal (Vbus), a pair of differential signal high-speed receiving terminals (RX2+, RX2−), and a ground terminal (GND). That is, the two terminals at the outermost side of the multiple terminals in the upper row are both the ground terminals. The arrangement order from right to left of the multiple terminals in the lower row is sequentially a ground terminal (GND), a pair of differential signal high-speed transmission terminals (TX2+, TX2−, i.e. a pair of USB 3.0 terminals, a power terminal (Vbus), a reserved terminal (CC2), a pair of USB 2.0 differential terminals (Dp2, Dn2), a reserved terminal (SBU2), a power terminal (Vbus), a pair of differential signal high-speed receiving terminals (RX1+, RX1−), and a ground terminal (GND). That is, the two terminals at the outermost side of the multiple terminals in the lower row are both the ground terminals. The multiple terminals located in the upper and lower rows on the insulating body 3 are arranged in such a way that the electrical connector 100 can be plugged in forwardly and reversibly.

As shown in FIG. 9 and FIG. 10, when the insulating body 3 is formed outside the terminal module 1 and the second terminal 2 by injection-molding, the first guide surface 123 in each of the mold core cavities 121 can guide a corresponding mold core column to be inserted into the mold core cavity 121. Three mold core columns located below the positioning seat 12 can be inserted into the mold core cavities 121 respectively, thereby limiting the positioning seat 12 in front, back, left and right directions, and pushing up against and limiting the positioning seat 12. The mold core columns located above the positioning seat 12 downward abut the top surface of the positioning seat 12, thereby preventing deviation of the first soldering portion 113 caused by expansive deformation of plastics of the positioning seat 12, and thus improving the positioning accuracy. After the plastics of the insulating body 3 are cooled, the second mold core holes 34 will be reserved on the top surface of the base portion 31, and the first mold core holes 33 will be reserved on the bottom surface of the base portion 31.

In this embodiment, at first, the insulating block 13 is formed outside the first terminal 11 and the middle shielding sheet 14 by injection-molding, and the first contact portion 111 is tightly attached to and exposed from the bottom surface of the tongue piece 134. Meanwhile, positioning posts of a mold are inserted into the first through holes 143 of the middle shielding sheet 14. Since there is a clearance between each positioning post and the inner edge of the corresponding first through hole 143, the molten plastic material forming the tongue piece 134 may flow into the clearances and form the bridging portion 1341 of the tongue piece 134 after cooling. Then, the second terminal 2 is engaged to the top surface of the insulating block 13, and the second contact portion 21 is tightly attached to and exposed from the top surface of the tongue piece 134. Finally, when the insulating body 3 is formed outside the terminal module 1 and the second terminal 2 by injection-molding, the grooves 135 on the top and bottom surfaces of the tongue piece 134 are used as flowing passages for the molten plastic material forming the insulating body 3, and the plastic circulates along the grooves 135, so as to facilitate filling of the plastic forming the insulating body 3.

To sum up, the electrical connector 100 according to certain embodiments of the present invention has the following beneficial effects.

(1) In the electrical connector 100, the grooves 135 are concavely provided on the top and bottom surfaces of the front end of the tongue piece 134. Each of the grooves 135 is located between two adjacent first terminals 11. Each groove 135 runs forward through the front end surface of the tongue piece 134, and extends backward beyond the rear end of the first contact portion 111. When the insulating body 3 is formed outside the terminal module 1 and the second terminal 2 by injection-molding, the grooves 135 are used as flowing passages for the molten plastic material forming the insulating body 3, so as to facilitate plastic filling.

(2) Each groove 135 extends backward beyond the rear end of the first contact portion 111 of the first terminal 11, so as to prevent the molten plastic material from covering outer surfaces of the first contact portion 111 of the first terminal 11 and the second contact portion 21 of the second terminal 2 when the insulating body 3 is formed outside the first terminal 11 and the second terminal 2 by injection-molding, which may undesirably cause poor contact.

(3) When the tongue piece 134 is formed outside the first terminal 11 and the middle shielding sheet 14 by injection-molding, the molten plastic material forming the tongue piece 134 flows into the clearances between the positioning posts of the mold and the first through holes 143 of the middle shielding sheet 14, and is cooled to form the bridging portions 1341 of the tongue piece 134, thereby preventing the positioning posts from touching the middle shielding sheet 14, so that the middle shielding sheet 14 is not displaced.

(4) The penetration holes 136 on the tongue piece 134 are corresponding to and communicated with both the second through holes 144 of the middle shielding sheet 14 and the through slots 36 on the tongue 32, for convenience of cutting off the material strips of the terminals.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a terminal module, comprising an insulating block, a middle shielding sheet retained in the insulating block, and a plurality of first terminals retained at the insulating block, each of the first terminals having a first contact portion exposed from a bottom surface of the insulating block, wherein the insulating block comprises a tongue piece, a top surface or the bottom surface of the insulating block is concavely provided with at least one groove, each of the at least one groove located between two adjacent ones of the first terminals, and the groove runs forward through a front end surface of the insulating block and extends backward beyond a rear end of the first contact portion;

a second terminal, located on the insulating block, wherein the second terminal has a second contact portion, and the second contact portion is exposed from the top surface of the insulating block; and an insulating body, formed outside the terminal module and the second terminal by injection-molding, wherein the middle shielding sheet is located between the first terminals and the second terminal; and wherein the middle shielding sheet is provided with a through hole, the tongue piece is provided with a penetration hole running through the top surface and the bottom surface of the tongue piece, the through hole is communicated with and the penetration hole, and the through hole is located between two adjacent ones of the first terminals.

2. The electrical connector of claim 1, wherein the insulating block comprises a main body portion, the tongue piece extends forward from the main body portion, a top surface and a bottom surface of tongue piece are concavely provided with a plurality of the grooves, the first contact portion is exposed from the bottom surface of the tongue piece, and the second contact portion is exposed from the top surface of the tongue piece.

3. The electrical connector of claim 2, wherein each of the first terminals has a first connecting portion and a first soldering portion, the first connecting portion is connected to the first contact portion and the first soldering portion, the first connecting portion has a first extending portion connected to the first contact portion, and the first extending portion is retained in the main body portion.

4. The electrical connector of claim 3, wherein the terminal module comprises a positioning seat, the first connecting portion comprises a first retaining portion connected to the first extending portion and the first soldering portion, and the first retaining portion is retained in the positioning seat.

5. The electrical connector of claim 4, wherein the positioning seat is formed outside the first retaining portion by injection-molding.

6. The electrical connector of claim 4, wherein two protruding blocks are provided at two sides of the positioning seat, two fixing grooves are provided at two sides of the main body portion, and the protruding blocks are fastened into the fixing grooves.

7. The electrical connector of claim 3, wherein the insulating block is formed outside the first contact portion, the first extending portion, and the middle shielding sheet by injection-molding.

8. The electrical connector of claim 3, wherein the second terminal has a second connecting portion and a second soldering portion, the second connecting portion is connected to the second contact portion and the second soldering portion, the main body portion is provided with a clamping groove, and the second connecting portion is engaged into the clamping groove.

9. The electrical connector of claim 8, wherein the insulating body comprises a base portion and a tongue extending forward from the base portion, and the second contact portion and the first contact portion are respectively exposed from a top surface and a bottom surface of the tongue.

10. The electrical connector of claim 9, wherein the first connecting portion and the second connecting portion are retained in the insulating body, the first connecting portion and the second connecting portion cross the base portion and the tongue, and both the first soldering portion and the second soldering portion penetrate through a bottom surface of the base portion.

11. The electrical connector of claim 9, wherein the groove is located in the tongue.

12. The electrical connector of claim 2, wherein a top surface or a bottom surface of the middle shielding sheet is partially exposed from the grooves.

13. The electrical connector of claim 2, wherein the middle shielding sheet is provided with a bridging through hole, the tongue piece comprises a bridging portion, and the bridging portion is located in the bridging through hole and is tightly attached to an inner edge of the bridging through hole.

14. The electrical connector of claim 13, wherein the bridging through hole is communicated with the grooves.

15. The electrical connector of claim 1, wherein the insulating body is provided with a through slot communicated with both the through hole and the penetration hole.

16. The electrical connector of claim 1, wherein a foremost end edge of the middle shielding sheet is located in front of a foremost end edge of the tongue piece.

17. The electrical connector of claim 1, wherein the groove is located between two adjacent first contact portions.

18. An electrical connector, comprising:

a terminal module, comprising an insulating block, a middle shielding sheet retained in the insulating block, and a plurality of first terminals retained at the insulating block, each of the first terminals having a first contact portion exposed from the insulating block, wherein the insulating block comprises a tongue piece, a top surface or the bottom surface of the insulating block is concavely provided with a groove located between two adjacent ones of the first terminals;

a second terminal, located at a side of the insulating block; and an insulating body, formed outside the terminal module and the second terminal by injection-molding, wherein at least a portion of plastic of the insulating body enters the groove, wherein the middle shielding sheet is located between the first terminals and the second terminal; and wherein the middle shielding sheet is provided with a through hole, the tongue piece is provided with a penetration hole running through the top surface and the bottom surface of the tongue piece, the through hole is communicated with and the penetration hole, and the through hole is located between two adjacent ones of the first terminals.

19. The electrical connector of claim 18, wherein the groove is located between two adjacent first contact portions.

20. The electrical connector of claim 19, wherein the groove runs forward through a front end surface of the insulating block.

21. The electrical connector of claim 19, wherein the groove extends backward beyond a rear end of the first contact portion.

22. The electrical connector of claim 18, wherein the groove is located between two adjacent second terminals.

23. The electrical connector of claim 18, wherein the insulating block is formed outside the first terminals by injection-molding.

24. The electrical connector of claim 18, wherein the insulating body is provided with a through slot communicated with both the through hole and the penetration hole.

* * * * *